US012460358B2

(12) United States Patent
Warren

(10) Patent No.: US 12,460,358 B2
(45) Date of Patent: Nov. 4, 2025

(54) MULTI-PURPOSE VIBRATORY CONCRETE TOOL

(71) Applicant: Warren Concrete Inc., Hiawassee, GA (US)

(72) Inventor: Kevin Warren, Hiawassee, GA (US)

(73) Assignee: Warren Concrete, Inc., Hiawassee, GA (US)

( * ) Notice: Subject to any disclaimer, the term of this patent is extended or adjusted under 35 U.S.C. 154(b) by 657 days.

(21) Appl. No.: 17/905,906

(22) PCT Filed: Mar. 2, 2021

(86) PCT No.: PCT/US2021/020510
§ 371 (c)(1),
(2) Date: Sep. 8, 2022

(87) PCT Pub. No.: WO2021/183325
PCT Pub. Date: Jun. 19, 2021

(65) Prior Publication Data

US 2023/0121043 A1 Apr. 20, 2023

Related U.S. Application Data

(60) Provisional application No. 63/205,343, filed on Dec. 3, 2020, provisional application No. 63/205,160, filed
(Continued)

(51) Int. Cl.
*E01C 19/38* (2006.01)
*E01C 19/40* (2006.01)

(52) U.S. Cl.
CPC ..... *E01C 19/38* (2013.01); *E01C 19/402* (2013.01)

(58) Field of Classification Search
CPC ..... E01C 19/38; E01C 19/40; E01C 19/402; E01C 19/32; E01C 19/30; E01C 19/35; B28B 1/29; E04G 21/066
See application file for complete search history.

(56) References Cited

U.S. PATENT DOCUMENTS 4,752,156 A * 6/1988 Owens ..... E01C 19/006 404/118
5,857,803 A 1/1999 Davis et al.
(Continued)

OTHER PUBLICATIONS

International Searching Authority, Patent Cooperation Treaty, "International Search Report and Written Opinion," International Application No. PCT/US2021/020510, date of mailing Mar. 2, 2021.
(Continued)

*Primary Examiner* — Abigail A Risic
(74) *Attorney, Agent, or Firm* — Chad G. Clark; Martensen IP

(57) ABSTRACT

The disclosed invention includes embodiments of a multi-purpose device for working concrete surfaces, the devices designed to use linear vibratory motion provided by a source of linear oscillations, and adaptable for a number of concrete working tasks. Devices include a support pole designed to connect a concrete implement to a commercially available reciprocating saw, a mass for magnifying the effects of the saw oscillations, and other features to enable safe, comfortable use. The invention further includes embodiments of a system for working concrete surfaces, the system comprising a concrete implement, a reciprocating saw, and a support frame for conveying oscillations from the reciprocating saw to the implement and for carrying the other system components.

19 Claims, 13 Drawing Sheets

Related U.S. Application Data on Nov. 18, 2020, provisional application No. 63/205,089, filed on Nov. 12, 2020, provisional application No. 63/205,018, filed on Nov. 9, 2020, provisional application No. 63/204,586, filed on Oct. 9, 2020, provisional application No. 63/204,102, filed on Sep. 11, 2020, provisional application No. 63/204,073, filed on Sep. 8, 2020, provisional application No. 63/103,436, filed on Aug. 5, 2020, provisional application No. 63/103,032, filed on Jul. 14, 2020, provisional application No. 63/102,758, filed on Jun. 29, 2020, provisional application No. 63/102,520, filed on Jun. 18, 2020, provisional application No. 63/102,471, filed on Jun. 15, 2020, provisional application No. 63/101,431, filed on Apr. 29, 2020, provisional application No. 63/101,356, filed on Apr. 27, 2020, provisional application No. 63/100,507, filed on Mar. 13, 2020.

(56) References Cited

U.S. PATENT DOCUMENTS

| | | | | |
|---|---|---|---|---|
| 6,200,065 | B1 | 3/2001 | Eitzen | |
| 7,153,058 | B2 * | 12/2006 | Lindley | E04F 21/242 404/115 |
| 7,175,365 | B1 | 2/2007 | Breeding | |
| 2012/0183351 | A1 | 7/2012 | Brening | |
| 2015/0022040 | A1 | 1/2015 | Mikowychok | |
| 2018/0278121 | A1 * | 9/2018 | Mikowychok | H02K 7/061 |

OTHER PUBLICATIONS

International Bureau of Wipo, "International Preliminary Report on Patentability," International Application No. PCT/US2021/020510, date of mailing Sep. 22, 2022.

* cited by examiner

MULTI-PURPOSE VIBRATORY CONCRETE TOOL

CROSS-REFERENCE TO RELATED APPLICATIONS

This application claims priority to the following U.S. Provisional Application Nos. 63/100,507, filed Mar. 13, 2020; 63/101,356, filed Apr. 27, 2020; 63/101,431, filed Apr. 29, 2020; 63/102,471, filed Jun. 15, 2020; 63/102,520, filed Jun. 18, 2020; 63/102,758, filed Jun. 29, 2020; 63/103,032, filed Jul. 14, 2020; 63/103,436, filed Aug. 5, 2020; 63/204,073, filed Sep. 8, 2020; 63/204,102, filed Sep. 11, 2020; 63/204,586, filed Oct. 9, 2020; 63/205,018, filed Nov. 9, 2020; 63/205,089, filed Nov. 12, 2020; 63/205,160, filed Nov. 18, 2020; 63/205,343, filed Dec. 3, 2020; the disclosures of which are hereby incorporated by reference herein in their entirety.

BACKGROUND

Field of the Invention

The disclosed invention relates to devices for working concrete, wherein the device is a lightweight, motorized tool suitable for multiple concrete floating and finishing tasks.

Relevant Background

Concrete workers have a pronounced need for a lightweight tool that can perform a number of different concrete floating and finishing tasks. Existing tools tend to be bulky, heavy, complex, and are often powered by attached internal combustion engines (ICE) or specialized batteries. In addition, existing concrete tools are single-purpose, requiring multiple tools to perform all of the necessary tasks required for a typical concrete installation job. Such tasks include edging, jointing, brooming, floating, bull floating, flattening or compressing control joints into concrete. Further, most existing tools use an eccentric weight to produce vibrations, which are almost universally oriented perpendicular to the motion of the tool across the finishing surface. See, e.g., U.S. Pat. No. 5,857,803 (ICE powered single-purpose screeding tool); U.S. Pat. No. 8,608,402 (ICE or backpack-ported battery powered single-purpose screeding tool); US 2011/0164923 (ICE powered wheeled single purpose screeding tool).

As is apparent from the above discussion, current devices have a number of shortcomings that expose device users to inconvenience, fatigue, and injury from transporting and operating multiple heavy concrete tools for various purposes. Therefore, it is apparent that a need exists for a light weight motorized concrete tool that is adaptable for a number of concrete working tasks.

The disclosed invention addresses the stated needs, in part, through employing a commercial reciprocating tool as the source of vibration. The lightweight power source enables the body of the disclosed concrete tool to be lightweight and simple to operate. The vibratory mass is interchangeable for weights that facilitate different tasks. Finally, the parallel orientation of the vibration source is suitable for a number of concrete working tasks.

A vibratory concrete tool with the disclosed features will allow a user to enhance production with less physical exertion, and hence less muscle soreness, exhaustion, and injury. These and other deficiencies of the prior art are addressed by one or more embodiments of the disclosed invention. Additional advantages and novel features of this invention shall be set forth in part in the description that follows, and in part will become apparent to those skilled in the art upon examination of the following specification or may be learned by the practice of the invention. The advantages of the invention may be realized and attained by means of the instrumentalities, combinations, compositions, and methods particularly pointed out hereafter.

BRIEF DESCRIPTION OF THE DRAWINGS

Features and objects of the disclosed invention and the manner of attaining them will become more apparent, and the invention itself will be best understood, by reference to the following description of one or more embodiments taken in conjunction with the accompanying drawings and figures imbedded in the text below and attached following this description.

Figure 1:
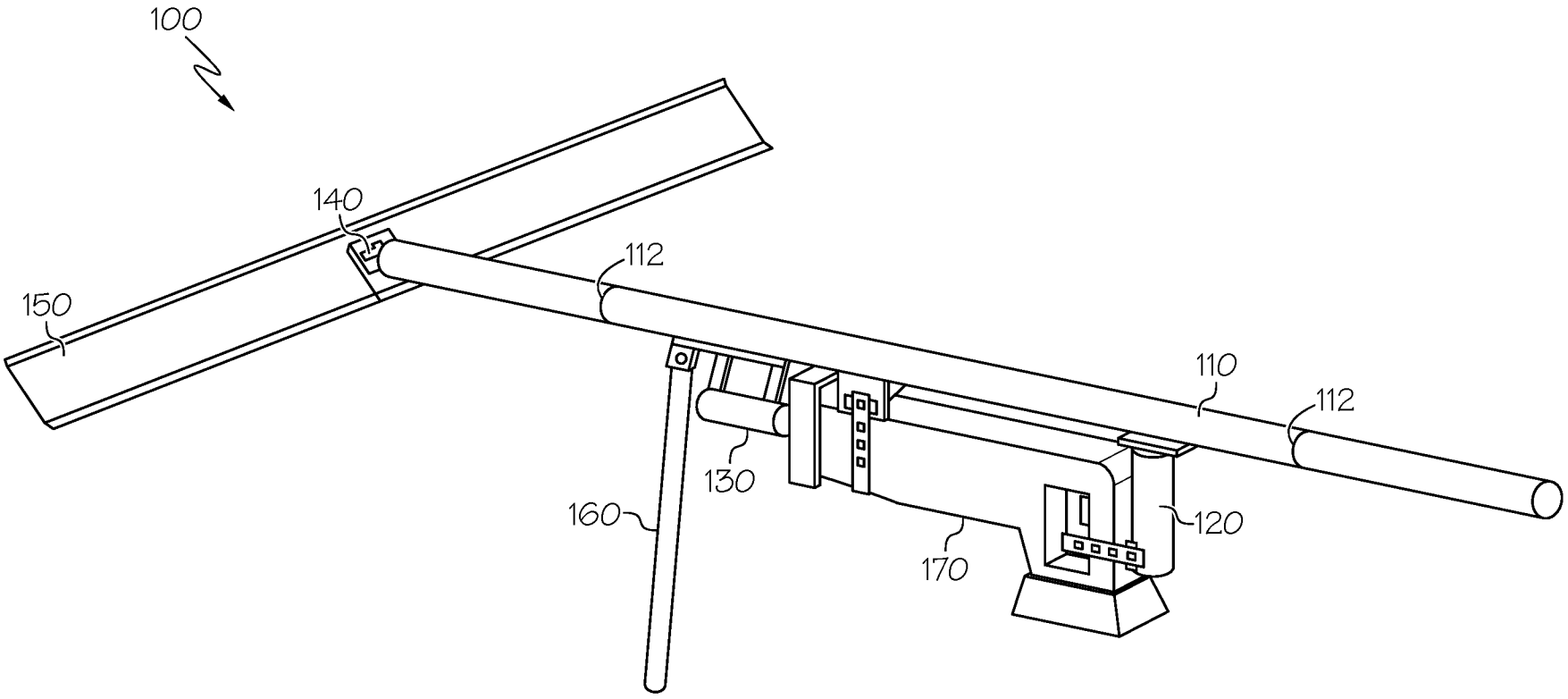
FIG. 1 depicts aspects of an embodiment of the disclosed multi-purpose vibratory concrete tool.

The Figures depict embodiments of the disclosed invention for purposes of illustration only. One skilled in the art will readily recognize from the following discussion that alternative embodiments of the structures and methods illustrated herein may be employed without departing from the principles of the invention described herein.

DETAILED DESCRIPTION

The detailed description of the disclosed invention will be primarily, but not entirely, limited to lightweight devices for working concrete surfaces, including linear vibratory motion provided by commercially available reciprocating tools, and adaptable for a number of concrete working tasks.

The disclosed invention will now be described in detail with reference to several embodiments thereof as illustrated in the accompanying Figures. In the following description, numerous specific details are set forth in order to provide a thorough understanding of embodiments of the invention. It will be apparent, however, to one skilled in the art that embodiments may be practiced without some or all of these specific details. In other instances, well known process steps and/or structures have not been described in detail in order to not unnecessarily obscure the disclosed invention. The features and advantages of embodiments may be better understood with reference to the drawings and discussions that follow.

It should be apparent to those skilled in the art that the described embodiments of the disclosed invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the disclosed invention as defined herein and equivalents thereto. Hence, use of absolute and/or sequential terms, such as, for example, "always," "will," "will not," "shall," "shall not," "must," "must not," "first," "initially," "next," "subsequently," "before," "after," "lastly," and "finally," are not meant to limit the scope of the disclosed invention as the embodiments disclosed herein are merely exemplary.

It will be also understood that when an element is referred to as being "on," "attached" to, "connected" to, "coupled" with, "contacting", "mounted" etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

Vibratory Concrete Tool

With reference to FIG. 1, embodiments of the disclosed multi-purpose vibratory concrete tool 100 comprise a support pole 110, a handle 120, a mass guide 130, a strike plate (not shown), a vibratory mass (not shown), a gauge frame 140, an implement 150, a support stand 160, and are used with a standard reciprocating saw 170. To operate the disclosed concrete tool, a user places the support pole 110 over one shoulder, grips the handle 120 with the hand on the same side, places the implement 150 flat on a concrete surface (not shown), and walks the tool backward across the finishing surface. The user may introduce vibratory motion to the implement by actuating the reciprocating saw 170, which produces rapid linear oscillations of the vibratory mass, which then impacts a strike plate located within the mass guide 130. The linear vibration transmits from the strike plate, through the support pole 110, to the gauge frame 140, and to the implement 150. The support stand 160 may be deployed to support the tool 100.

The support pole 110 is configured to serve as a handle for the implement 150, and carries the other support frame components. In some embodiments, the support pole is a length of hollow aluminum tubing with a circular cross section, or may have a square or triangular cross section, may be solid or hollow, and may be made from other suitable materials, e.g., titanium, magnesium, carbon fiber, fiberglass, CroMoly, wood, etc. The support pole 110 may be between 3 feet and 20 feet long, and is either a single piece, or comprised of multiple pieces fitted together at one or more joints 112 (two are shown). Such joints may be compression joints, internal couplings, spring pin, thread and socket, or other suitable joints. The support pole can be extended or shortened based on the needs of the application, or if a single piece, is sized as appropriate for the application.

Figure 2:
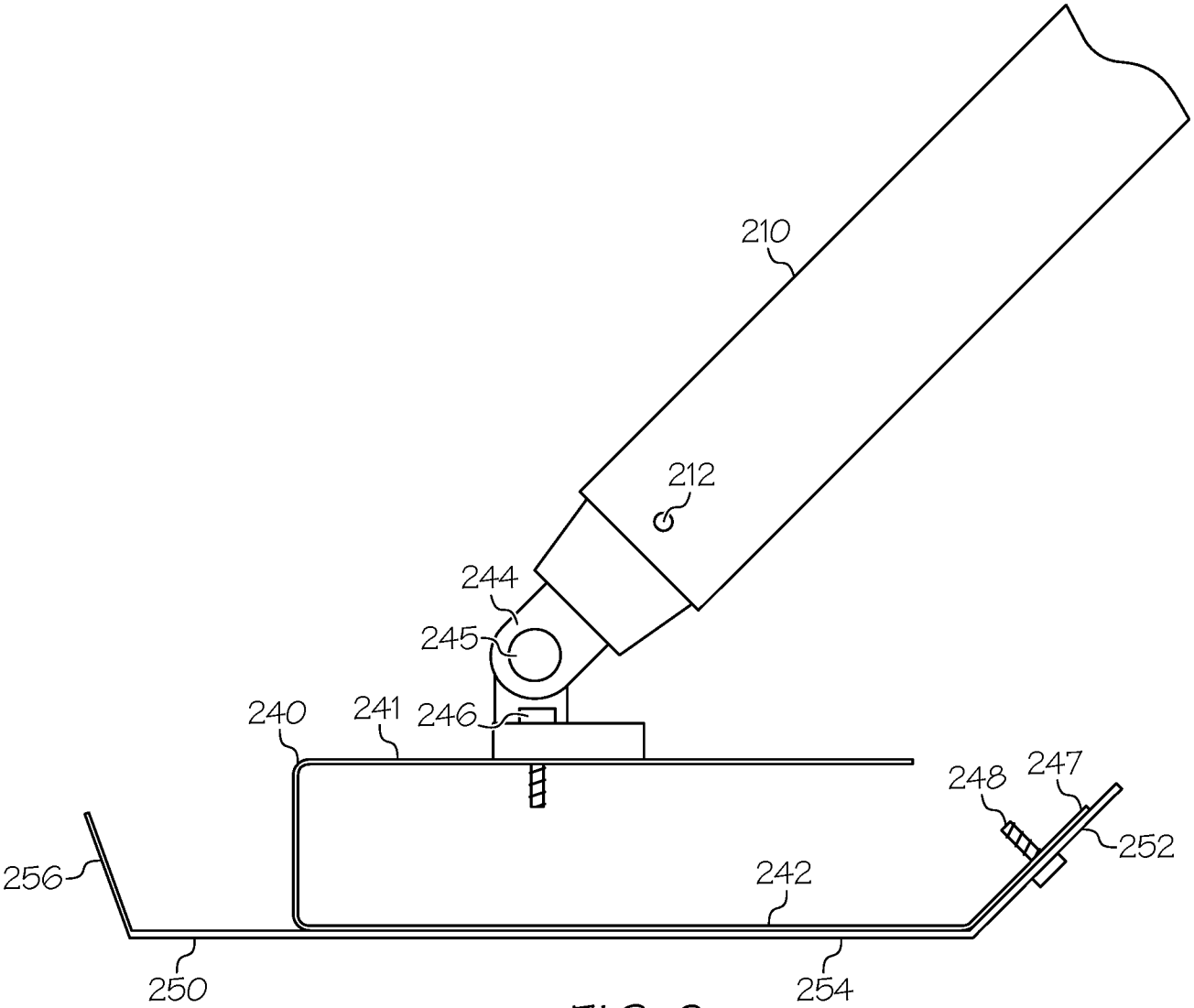
FIG. 2 depicts a side view of aspects of the disclosed multi-purpose vibratory concrete tool.

With reference to FIG. 2 which shows a side profile view of a portion of the device, one end of the support pole 210 attaches to the implement 250 via the gauge frame 240. The gauge frame 240 includes a pole interface 241, and a blade interface 242. The gauge frame 240 is made of a single piece of metal, e.g., aluminum, magnesium, etc., folded into shape, or may be a plurality of pieces welded or otherwise joined together. On the pole interface 241, the gauge frame 240 also includes a lockable hinge joint 244. The joint 244 is used to adjust the support pole angle with respect to the implement by turning around the pivot 245. The pivot 245 is a threaded bolt that can be tightened by use of a nut to set the pole angle. The inner surfaces of the joint may also feature interlocking teeth to further secure the joint position. The joint 244 may fit inside the end of the support pole 210 and may be secured by a bolt 212 or pin, or may feature a threaded socket configured to interact mechanically with threads on the end of the support pole. Other suitable joints and connections may be used and are contemplated. The hinge joint is secured to the gauge frame 240 by a plurality of bolts 246, or may be secured by screws, welding, or industrial adhesives. The blade interface 242 is configured to interact mechanically with the implement 250. The blade interface 242 component of the gauge frame may include a fold 247, crimp, lip, or welded piece corresponding to a lip 252 on the implement. The blade interface 242 is secured to the blade by a plurality of bolts 248, or may be secured by screws, welding, or industrial adhesives. The bolts 248 or other attachment means are located so that they will not contact the surface to be finished.

The implement 250 as shown is a screeding blade configured to produce a smooth, flat surface on concrete. The size, shape, and material of the implement 250 will vary based on the finishing task performed by the tool. As depicted, a screeding implement embodiment comprises a rear lip 252 located behind the support pole 210. The rear lip 252 is shown angled up 45 Degrees (°) from a finishing surface 254. The finishing surface 254 is flat and smooth. At the front of the implement 250 is a front lip 256. The front lip 256 is shown angled 10° from vertical in the direction away from the support pole 210. The implement 250 may be made from magnesium, aluminum, or other strong, durable, and lightweight material. For screeding, the implement may have a finishing surface 254 that is 8 inches wide and 48 inches long. However screeding implements may vary greatly in length depending on the application. For example, a common sidewalk is 4 feet wide, and therefore a 4 foot long screeding implement is suitable to pull across the top surface of the concrete. For other applications, such as wet screeding, a type of screeding done without solid vertical supports on each end of the finishing blade, the screeding implement may be 14 feet long.

Other concrete implements are possible and contemplated. Such implements may include blades adapted to perform edging, jointing, brooming, come along raking, bull floating, flattening, leveling, or compressing control joints. Finishing implements can be configured to texture, imprint, color, print, paint, permeate, stamp, stain, emboss, color, or scratch concrete surfaces. Other concrete working implements may be attached to the disclosed tool by various means, e.g., separating the joint 244 from the support pole 210, separating the joint at the pivot 245, or separating the blade 250 from the gauge frame 240, and then removing the separated parts, and replacing the removed parts with corresponding parts of the new implement. Depending on the type of implement, the connection between the support pole and implement can vary. For example, a bull float implement or jointing implement may require an attachment means that allows the implement to rotate with respect to the support pole, while a come along rake is fixed both rotationally and with respect to the angle between the support pole and implement. Some implements may include mounting brackets for fastening multiple implements together when not in use to aid transport.

Figure 3A:
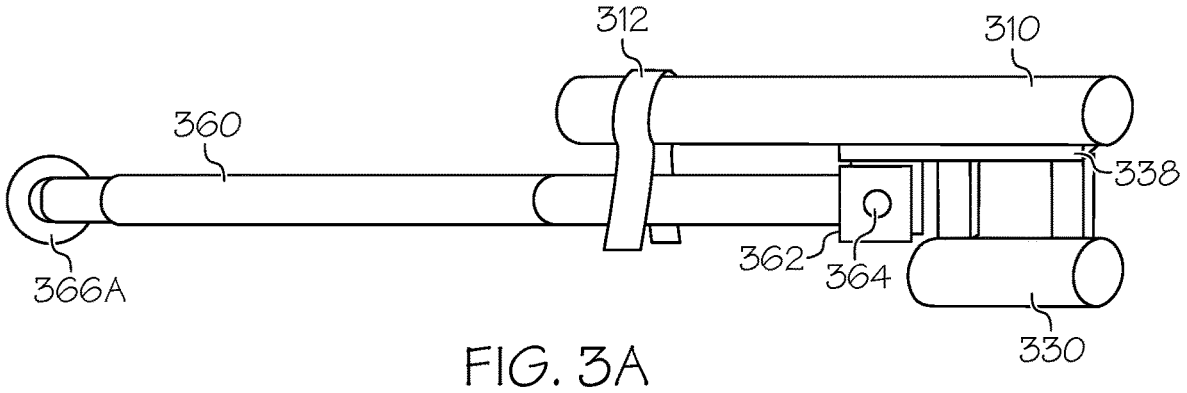
FIGS. 3A and 3B depict aspects of the disclosed multi-purpose vibratory concrete tool.
Figure 3B:
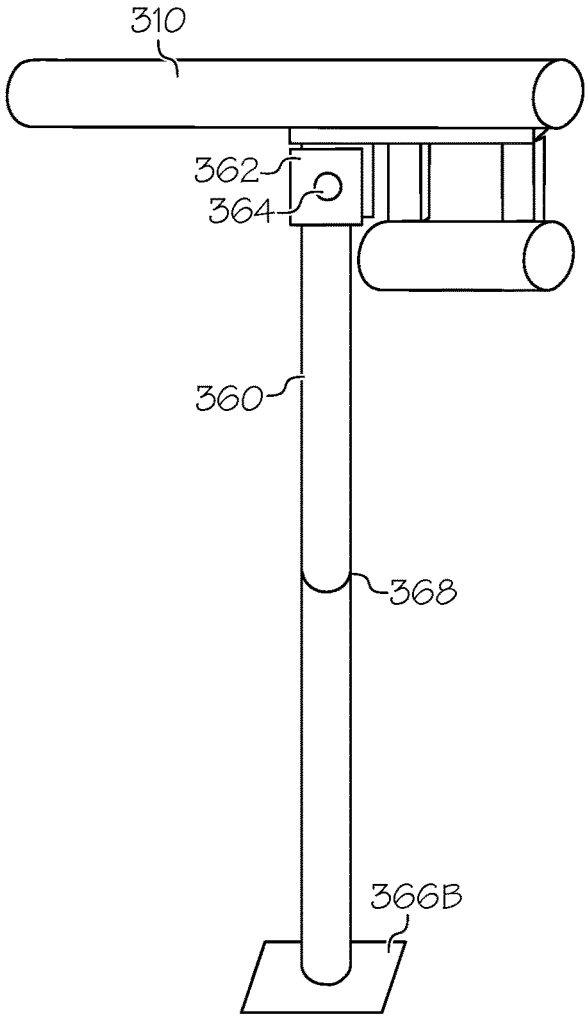

With reference to FIGS. 3A and 3B, a portion of the disclosed vibratory concrete tool is depicted featuring the support stand 360 and associated components. The support stand 360 is attached to a stand bracket 362 so that the support stand can be rotated about a pivot 364. FIG. 3A depicts the stand 360 in a stowed position, in which the stand folds along the support pole 310 in the direction of the implement to minimize interference with use of the tool. FIG. 3B shows the stand in a deployed position, in which it extends out from the support pole to support the tool against the ground, finishing surface, or other horizontal surface. In some embodiments, the support stand includes a wheel 366A or a foot plate 366B at the end opposite the attachment point, which may be removable and interchangeable. With the wheel 366A in place, the deployed stand can be used to support the tool while in use. As with the support pole, the stand may be a single piece, or may include a plurality of sections separable at one or more joints 368. Some embodiments may feature a clip 312 or other suitable means to hold the stand in place in the stowed position. In some embodiments, the stand bracket 362 interacts mechanically with the stand 360 to lock the stand in place. For example, the bracket 362 may include spring clips corresponding to stowed and deployed positions, wherein the clips interact with a hole in the stand 360. Alternately, the bracket 362 may include a plurality of holes corresponding to different stand positions, wherein a pin may be inserted through the bracket holes and through a hole in the stand 360 to lock the stand in place. Some embodiments include a spring to return the stand to the stowed position and maintain it there. A number of possible configurations are suitable and contemplated. The stand bracket 362 is secured to the crosspiece 338 at a location adjacent to the mass guide, on the side between the mass guide and implement. On embodiments without a crosspiece, the stand bracket 362 is attached directly to the support pole 310. In some embodiments, the support stand may be configured as a bipod or tripod.

Figure 4A:
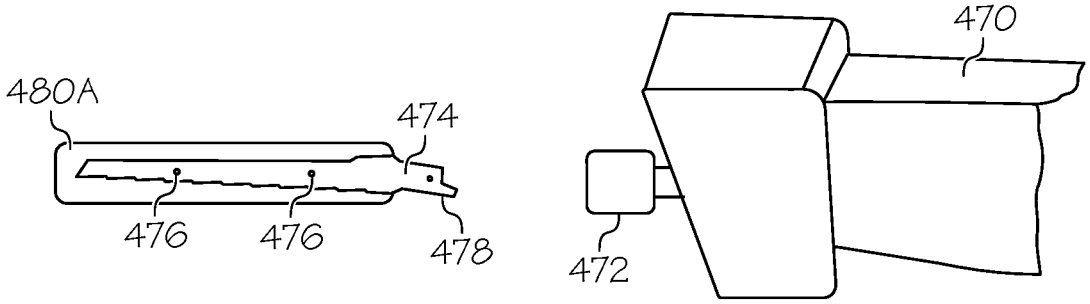
FIGS. 4A and 4B depict aspects of the vibratory mass portion of the disclosed multi-purpose vibratory concrete tool.
Figure 4B:
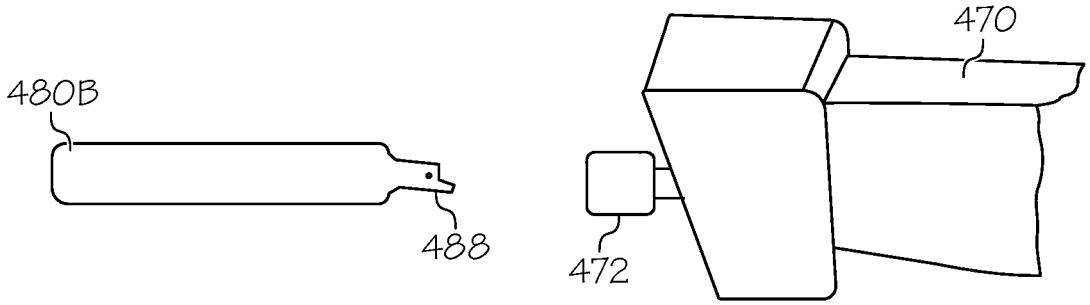

With reference to FIGS. 4A and 4B, embodiments of the vibratory mass 480A, 480B are depicted. In some embodiments, the mass is 6 inches long, ¾ inches wide, and weighs 11 ounces. This mass is sufficient to magnify vibrations from the reciprocating tool 470 at least 2 times (X), and as much as 10X. The mass is made out of iron or steel, or may be made from another dense metal or alloy such as copper, nickel, bronze, or lead. In some embodiments, the mass 480A is configured to attach to a standard reciprocating saw blade 474. The blade 474 is positioned so that the blade shank 478 extends past the end of the mass 480A and can be fitted in a standard blade clamp or collet 472 of a reciprocating saw 470. The mass 480A may be attached to the blade 474 by a plurality of screws or bolts 476, or may be welded, or secured by an epoxy or other adhesive. In such embodiments, the mass 480A may include a central channel (not shown) in one side and corresponding to the shape of the blade 472. The channel allows the blade to be recessed in the side of the mass to align the vertical center of mass of the blade with that of the vibratory mass. In some embodiments, the mass 480B includes a shank 488 at one end. The shank 488 is configured to mechanically interact with a standard clamp or collet 472 of a reciprocating saw 470.

Figure 5A:
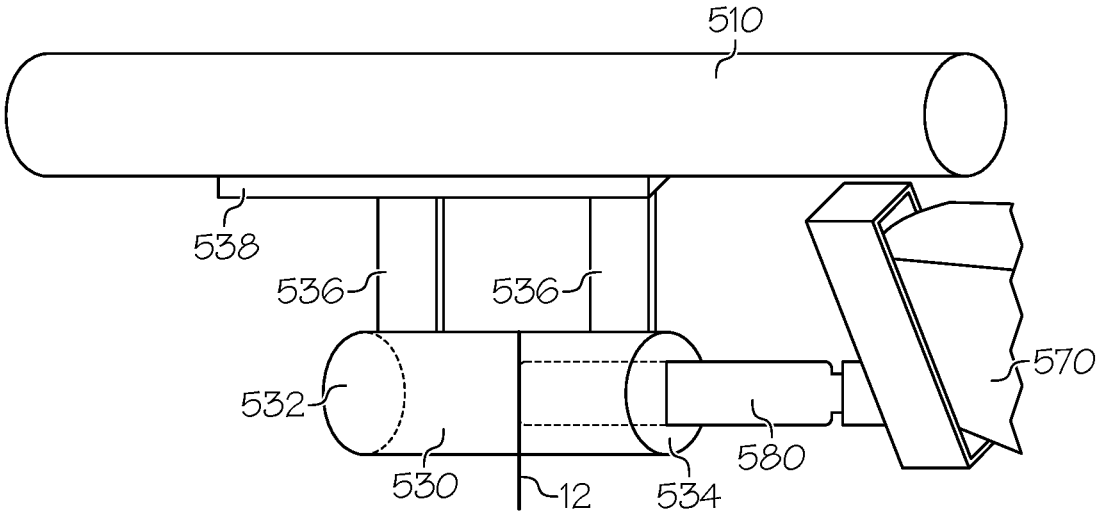
FIGS. 5A and 5B depict aspects of the disclosed multi-purpose vibratory concrete tool.
Figure 5B:
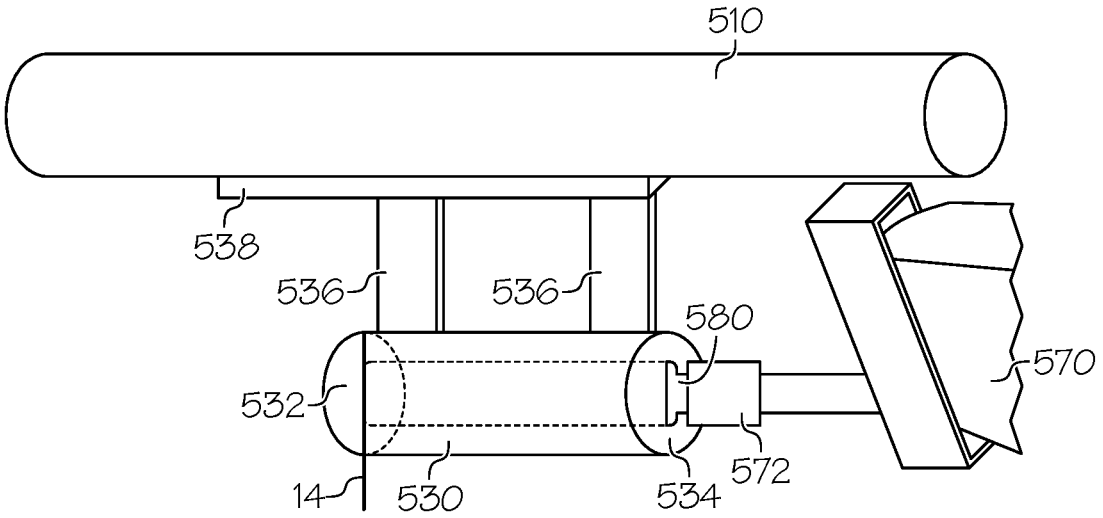

With reference to FIGS. 5A and 5B, in some embodiments linear vibrations are introduced to the tool through the interaction of the vibratory mass 580 with a strike plate 532. The strike plate 532 is located at an end of the mass guide 530 opposite from the mass guide opening 534. The strike plate is attached to the mass guide 530 by, e.g., welding, bolts, screws, brads, or other suitable means of attachment. Such means must be robust enough to withstand impacts from the vibratory mass 580, and to convey the resulting vibrations into the mass guide. The strike plate 532 and mass guide 530 are made from, e.g., aluminum, steel, titanium, carbon fiber, Kevlar, or other strong, lightweight material. The mass guide 530 is configured to direct the vibratory mass 580 into the strike plate 532, and to protect the tool user by shielding the moving parts. The mass guide therefore must be of sufficient length to substantially cover the vibratory mass throughout its range of motion, and for embodiments with a strike plate, is located so that the vibratory mass 580 impacts the strike plate 532. The mass guide 530 is a length of pipe, or may have a square or triangular cross section. The mass guide 530 is attached to the support pole 510 by various suitable means. Embodiments may include one or more spacers 536 (two are shown) attached to the mass guide. The spacer(s) 536 may then attach directly to the support pole 510 (not shown), or may attach first to a crosspiece 538, which is then attached to the support pole. While the spacers are shown extending perpendicularly between the mass guide and support pole, they may be oriented at different angles. In addition, spacer length can be adjusted to increase or decrease the distance from the support pole 510 to the mass guide 530 in order to align the mass guide with the vibratory mass 580. The spacers also may have various cross sections, e.g. rectangular, circular, triangular, etc., and may be solid or hollow. The spacer(s) and crosspiece may be made of similar materials as the mass guide. Secure connections capable of efficiently transmitting vibrations between the mass guide, spacers, crosspiece and support pole may be accomplished by use of bolts, welds, screws, brads, or epoxy or other adhesive.

The vibratory mass 580 is attached to the blade collet 572 of a reciprocating saw 570, which has been secured to the support pole as described below with respect to FIG. 6. With the saw 570 mounted, the mass 580 has a retracted position indicated by the line 12. The mass will be in the retracted position when the blade collet 572 on the reciprocating tool 570 is also fully retracted. The mass 580 also has a forward position, indicated by the line 14, in which the mass impacts the strike plate 532. The forward position 14 corresponds to the fully extended position of the collet 572.

Figure 6:
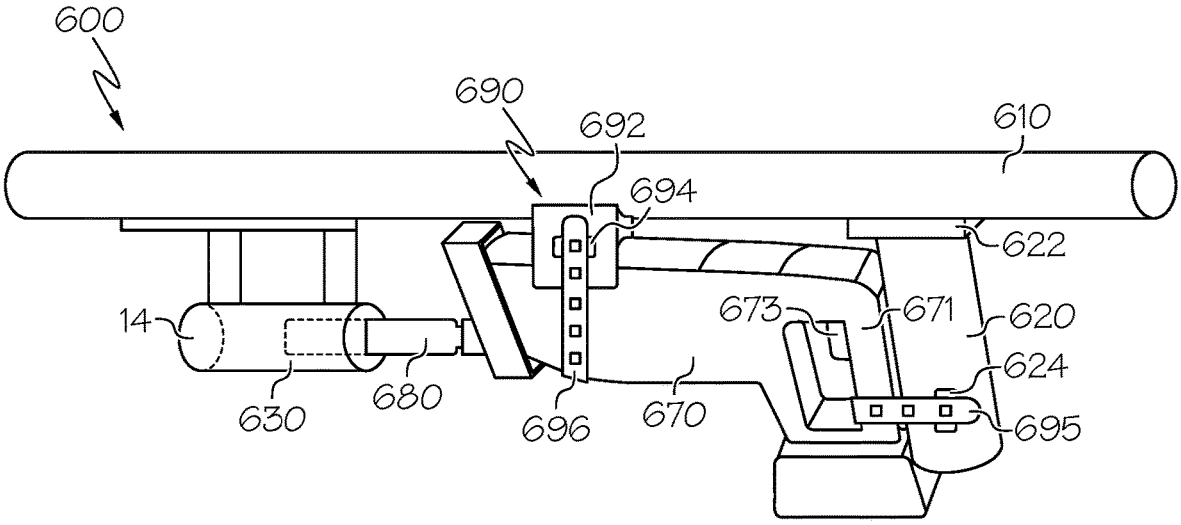
FIG. 6 depicts aspects of the disclosed multi-purpose vibratory concrete tool.

With reference to FIG. 6, a reciprocating saw 670 is removably secured to the disclosed vibratory tool 600 through one or more saw bracket(s) 690 (one is shown), and a handle clamp 695. The saw bracket 690 includes a saw cradle 692 that is removably secured to the support pole by one or more bolts, screws, worm clamps, or other suitable means. The saw cradle 692 may include a curved top side shaped to mechanically interact with the surface of the support pole 610. Further, the saw cradle 692 includes a bottom side that is configured to mechanically interact with one or more commercial reciprocating saw models. The saw cradle 692 further includes one or more tabs 694 (one is shown) configured to mechanically interact with a plurality of holes in a strap 696. The strap is made of rubber or other durable elastic material. The strap is attached to the back side (not shown) of the saw cradle 692 permanently, or by the tab and hole means described above, and is stretched under the saw 670 and secured to the tab on the front side. The disclosed tool 600 may include a plurality of such saw cradles, each configured to interact with a different saw model, or to interact with different parts of the same saw model. The mechanical interactions between the reciprocating saw 670, the saw cradle(s) 692 and the support pole 610 are configured to efficiently convey vibrations from the reciprocating saw through the support pole to the implement. Some embodiments may include alternate means to securely and removably attach the reciprocating saw to the tool 600. When attached, the saw 670 is located so that the vibratory mass 680 is inside the mass guide 630, and when in the forward position, reaches the line 14 so that the vibratory mass impacts the strike plate. In other embodiments not including a strike plate, or having a thrust rod, the saw 670 will be located to efficiently convey vibrations to the implement by the respective means.

A handle 620 is secured to the support pole 610 by means discussed above, including welds, bolts, screws, brads, or adhesives. The handle 620 may also be attached to a handle crosspiece 622 to improve handle strength and stability. In some embodiments, the handle is flexibly attached to the support pole with a high tension spring to allow the handle to augment the vibratory motion of the reciprocating saw. The handle is made of strong, lightweight material, e.g., aluminum, steel, etc., and in some embodiments may be a section of aluminum pipe. The handle 620 is depicted as attached at an approximately 15° angle back toward the user from a line extending perpendicularly to the support pole, however, other angles, including perpendicular to the support pole are possible and will be selected based on user comfort and compatibility with one or more reciprocating saw handles 671. Some embodiments include multiple handles, located to facilitate user comfort and control of the device. In some embodiments, the handle 620 further includes a groove or cut-out section configured to mechanically interact with the rear of the reciprocating saw handle 671, providing additional stability for the saw mount. In some embodiments, the handle includes vibration absorbing material, e.g., rubber, neoprene, sorbothane, EVA, foam, cork, or other durable, compact material capable of dampening vibrations, located at the interface of the saw handle 671 with the handle 620. In some embodiments, the handle 620 may be mountable in different locations along the support pole, facilitated by a series of mounting holes, a rail system, or a track system mounted linearly along the support pole 610 surface. The saw handle 671 is secured to the handle 620 by means of a handle clamp 695. The handle clamp is depicted as a rubber strap with holes that mechanically interact with tabs on the handle 620, however, other types of attachment means are possible, including a worm clamp, a zip tie, etc. In some embodiments, the reciprocating saw 670 is mounted on the top of the support pole 610.

Embodiments of the disclosed vibratory tool are designed for use with a number of commercially available reciprocating saws made by, e.g., Ryobi, Dewalt, Bosch, Milwaukee, Makita, etc. Such saws may have a lithium ion battery pack rated from 18/20 Volts (V) to 60 V, and can move the collet up to about 3000 cycles per minute over a throw distance of 1⅛ to 1½ inches by actuation of a variable speed trigger. The saws are typically about 17 inches long, and weigh around 7.5 pounds. Some embodiments may use a reciprocating saw with a cord for plugging into a power source. Commercial reciprocating saws have varying lengths, varying weights, and varying throw distances. Further, they feature different handle shapes, and different upper profiles. As a result, the disclosed tool is configured to be adaptable to different reciprocating saws, while achieving secure, removable mounting capable of producing the type of linear vibrations required for effective operation of the tool.

Some embodiments of the tool may be used with an oscillating tool, such as cordless Dewalt oscillating multi-tool. In such versions, vibratory oscillations will be lateral to the support pole, so the mass guide configuration will accommodate side-to-side motion rather than linear motion, and the connection means of the vibratory mass must correspond to that of the multi-tool. Further, because of the different shape of such tools, other means of connecting the multi-tool to the support pole will be used.

Reciprocating saws used with the disclosed tool are actuated by a trigger 673 located on the saw handle 671. Vibrations may therefore be sent through the tool by actuating the trigger 673. Embodiments of the disclosed tool may also include modifications to the existing saw trigger, or additional or alternate trigger devices, located elsewhere on the tool, e.g., handle 620, support pole 610, or other suitable location. Some embodiments include a trigger stay (not shown), which is placed around the saw trigger and actuates the saw at one or more constant speeds. The trigger stay may be made out of, e.g., plastic, nylon, or metal, and may function like a reusable zip tie or other similar releasable, adjustable, locking tab and slot combination. Alternate triggers may be configured with power switch to actuate the reciprocating saw, and a speed control to adjust the number of strokes per minute output by the saw. Alternate triggers may also be configured with wireless communication equipment, e.g., Bluetooth, WiFi, RFID, ZigBee, IrDA, cellular, etc., and activated remotely from e.g., inside a building, a vehicle, etc.

Figure 7A:
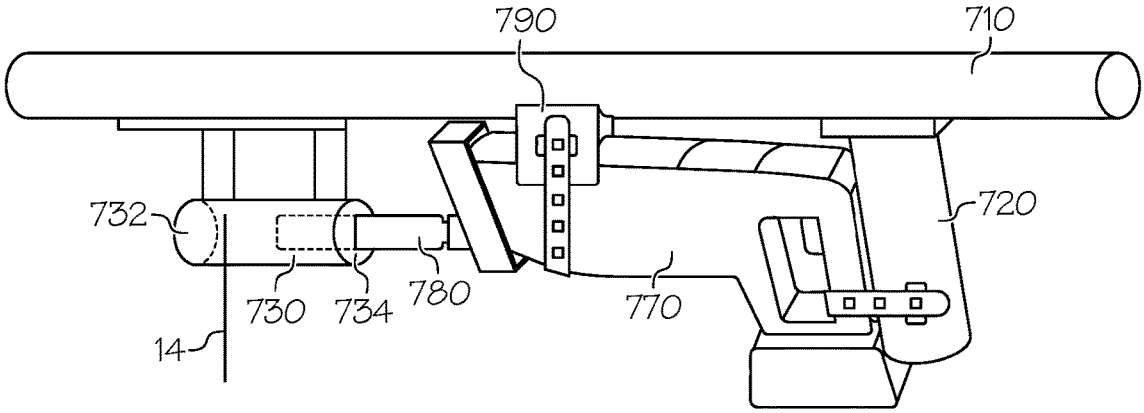
FIGS. 7A, 7B, 7C, 7D, and 7E depict aspects of the disclosed multi-purpose vibratory concrete tool.

With reference to FIG. 7A, some embodiments feature a mass guide 730 that does not have a strike plate, and instead is open on both ends 734, 732. Alternatively, some embodiments may feature a reciprocating tool mounting location that does not allow the mass 780 to impact the strike plate, here depicted by the line 14 showing the forward position of the mass not reaching the strike plate location. In such embodiments, linear vibrations produced by the saw 770 and mass 780 are conveyed to the implement through the saw 770, through the saw bracket(s) 790, and into the support pole 710. Tool handles 720 will not be used to convey vibrations, but instead will feature isolating materials to reduce user fatigue and discomfort.

Figure 7B:
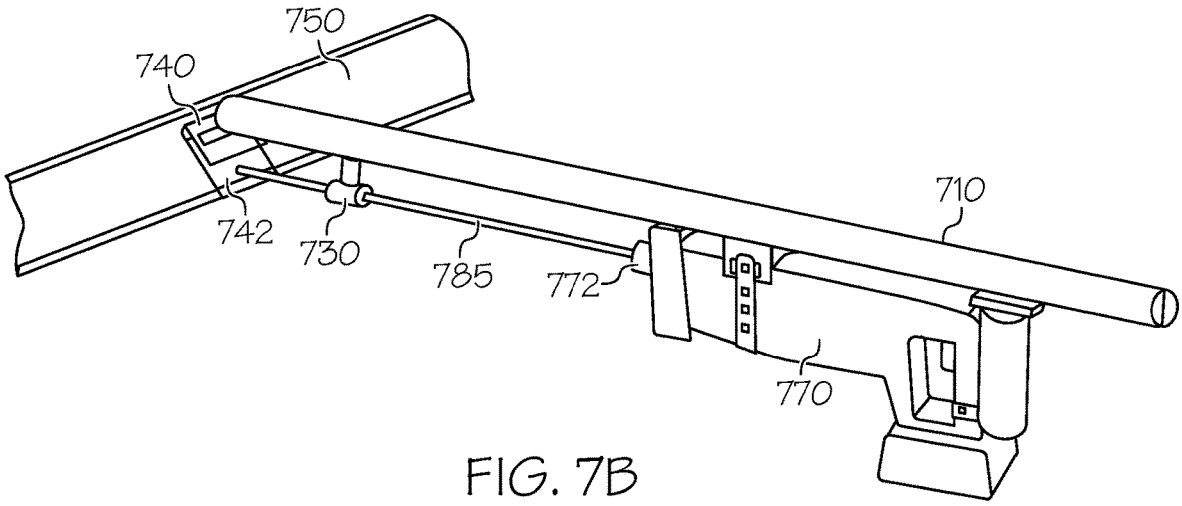

With reference to FIG. 7B, some embodiments are configured with a thrust rod 785 instead of a vibratory mass 780. The thrust rod 785 is a solid metal rod or dowel made from a heavy, flexible material, such as steel. The thrust rod 785 mechanically interacts with the blade collet of the reciprocating saw by similar means as discussed above with respect to the mass 480 in FIG. 4, or by other suitable means, and extends to the implement 750. Some embodiments may include a rod tip (not shown), which caps the end of the thrust rod nearest the implement, and provides durability, or modifies vibration characteristics for various tasks. The rod tip may be replaceable, and is made from a metal, an alloy, or an aggregate substance. The thrust rod 785 is configured to impact a strike plate 742, here shown as a gauge frame 740 modified to have an exposed blade interface section 742. In some embodiments, the strike plate may be angled so that the bottom of the thrust rod impacts the strike plate at or near a 90° angle. The strike plate 742 is made of, e.g., aluminum, steel, titanium, carbon fiber, Kevlar, or other suitable material. The strike plate 742 may be made of the same or different material as the remainder of the gauge frame 740. Some embodiments using a thrust rod 785 do not include a gauge frame, but instead the support pole 710 attaches directly to the strike plate 742 via an adjustable joint (not shown). Further, embodiments using a thrust rod 785 may include a support stand (not shown) mounted out of the way of the thrust rod, and may also include a mass guide 730 to direct the thrust rod into the strike plate 742. The mass guide 730 in such embodiments may be located along the support pole 710 closer to the strike plate 742 than the reciprocating saw 770 to effectively guide the thrust rod. In operation, the reciprocating saw 770 moves the thrust rod rapidly against the strike plate, which conveys vibrations directly to the implement 750. In some thrust rod embodiments, the thrust rod is hollow and contains a weight that is free to move within the rod. The motion of the weight within the rod will enhance the vibratory motion of such embodiments.

Figure 7C:
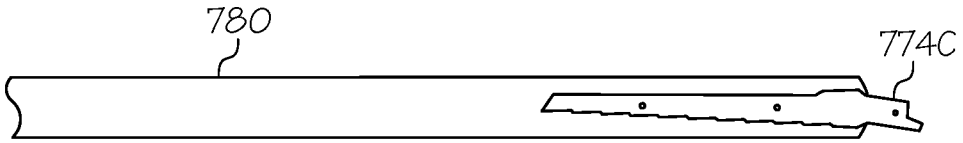
Figure 7D:
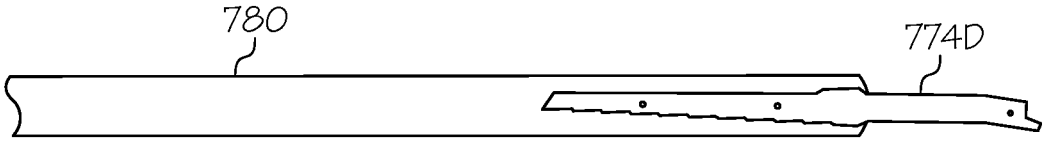
Figure 7E:
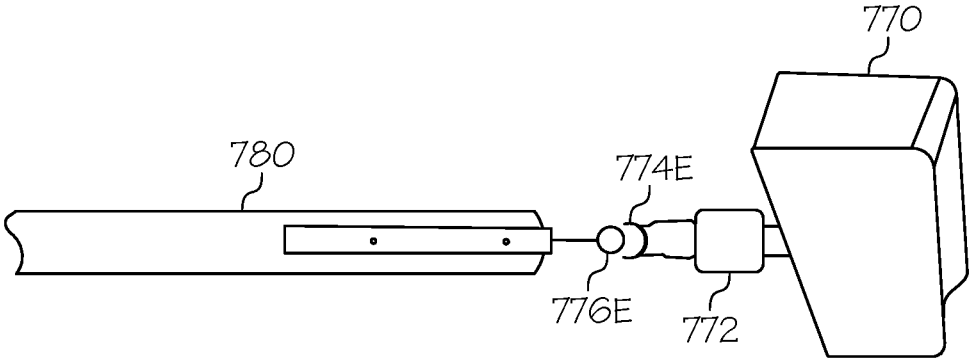

Some embodiments with a thrust rod may include features to mitigate the effects of heat build-up caused by thrust rod impact with the strike plate, or friction caused by mechanical interaction with the mass guide. The mass guide may be lubricated with grease, which may be retained by use of bushings or seals. Another alternative is to construct the thrust rod and/or mass guide out of a self-lubricating metal, such as bronze. In other embodiments, modifications may be made to increase radial motion of the thrust rod within the mass guide. For example, with reference to FIGS. 7C and 7D, the standard mechanical interface 774C with the reciprocating tool may be extended 774D to effectively relocate the thrust rod 780 farther away from the reciprocating tool. With reference to FIG. 7E, to provide desirable vibration characteristics for certain applications, the thrust rod 780 also may be mechanically linked to the reciprocating tool 770 via a hinged connection, such as a socket 774E that mechanically interacts with a ball 776E to create a ball and socket joint.

Figure 8A:
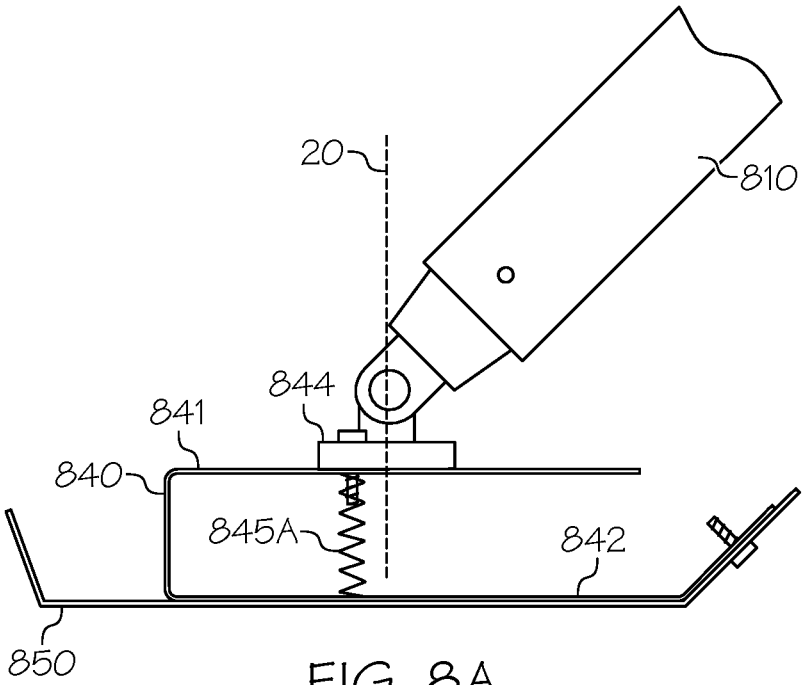
FIGS. 8A and 8B depict side views of aspects of the disclosed multi-purpose vibratory concrete tool.
Figure 8B:
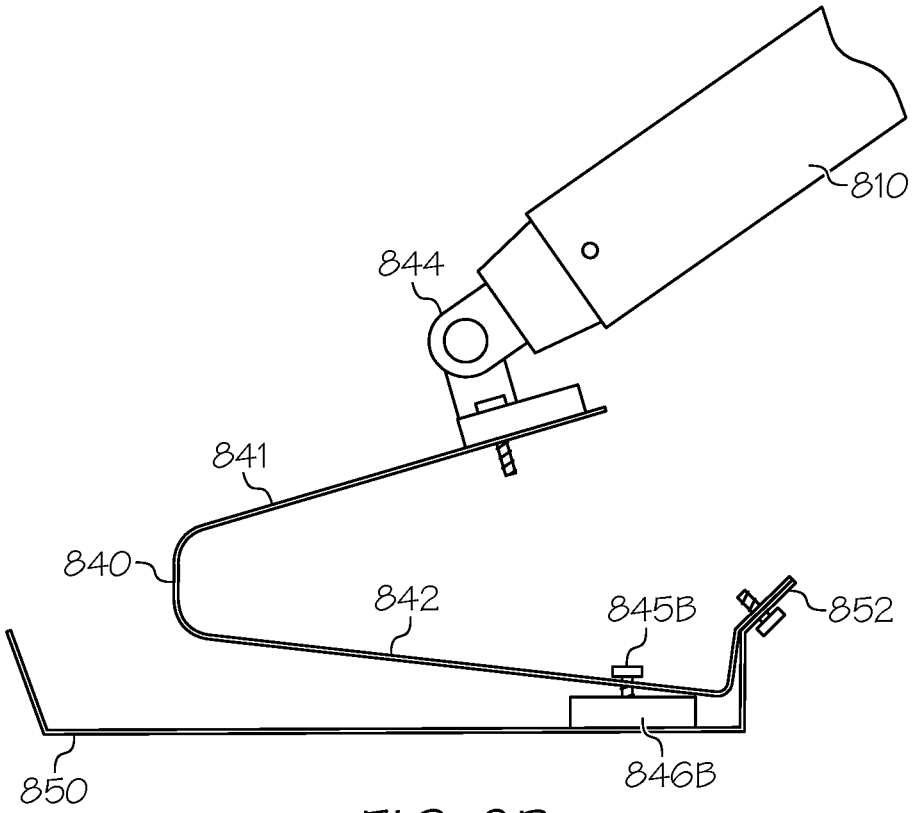

With reference to FIGS. 8A and 8B, some embodiments will feature an adjustable gauge frame 840. The adjustable gauge frame 840 is used to finely adjust the implement 850 interaction with the concrete surface by causing a lifting effect at the front or rear side of the implement. As shown in FIG. 8A, in some embodiments the adjustment is made by use of a spring adjustor 845A. In such embodiments, the support pole 810 is secured to the gauge frame by a pole bracket 844, with the support pole connection point centered on the pole bracket 844 front to rear. A spring adjustor 845A connects the blade interface 842 of the gauge frame with the pole interface 841. The pole bracket 844 mechanically interacts with the spring adjustor 845A through the pole interface 841. Depending on where they are attached, the pole bracket 844 and spring adjustor 845A will alter the distribution of vibratory pressure applied to the implement. The dotted line 20 bisects the pole bracket 844 front to rear. If the spring adjustor 845A is attached forward of the line 20 (as shown), vibratory pressure is increased on the rear portion of the gauge frame, causing the lifting effect on the front of the implement. Similarly, attaching the spring adjustor 845A to the rear of the line 20 will increase vibratory pressure on the front of the gauge frame, causing a lifting effect on the rear of the implement.

With reference to FIG. 8B, in some embodiments adjustment to vibratory pressure location is made by use of a screw adjustor 845B. In such embodiments, the support pole 810 attaches to the pole bracket 844, which is connected to the pole interface portion 841 of the gauge frame 840. The pole interface 841 may be oriented parallel to the blade interface 842 as depicted in FIG. 8A, or oriented at an angle as shown in 8B. An adjustment bar 846B is located between the blade 850 and the blade interface 842. The adjustment bar 846B length extends the width of the gauge frame, is, e.g., 1 inch wide, and is secured to the blade 850 by welding, bolts, screws, adhesives, or other suitable means. The gauge frame 840 rests on the adjustment bar 846B directly or through the adjustment screw 845B, and is attached to the rear lip 852 of the blade by a plurality of bolts or screws. The adjustment screw 845B is threaded through the blade interface 842 and mechanically interacts with the adjustment bar 846B. By extending the adjustment screw 845B through the blade interface 842, the adjustment screw will push against the adjustment bar 846B, causing the gauge frame to rotate up with the rear lip 852 connection as the pivot point. By retracting the adjustment screw 845B, the gauge frame will lower toward the blade 850. Altering the angle between the blade interface 842 and the blade 850 will change the vibratory pressure applied to the blade. Extending the adjustment screw 845B will tend to increase vibratory pressure on the rear of the blade, while retracting the adjustment screw 845B will tend to increase vibratory pressure on the front of the blade. The adjustable gauge frames as disclosed will enhance the tool's ability to produce a visually uniform concrete surface.

Figure 9:
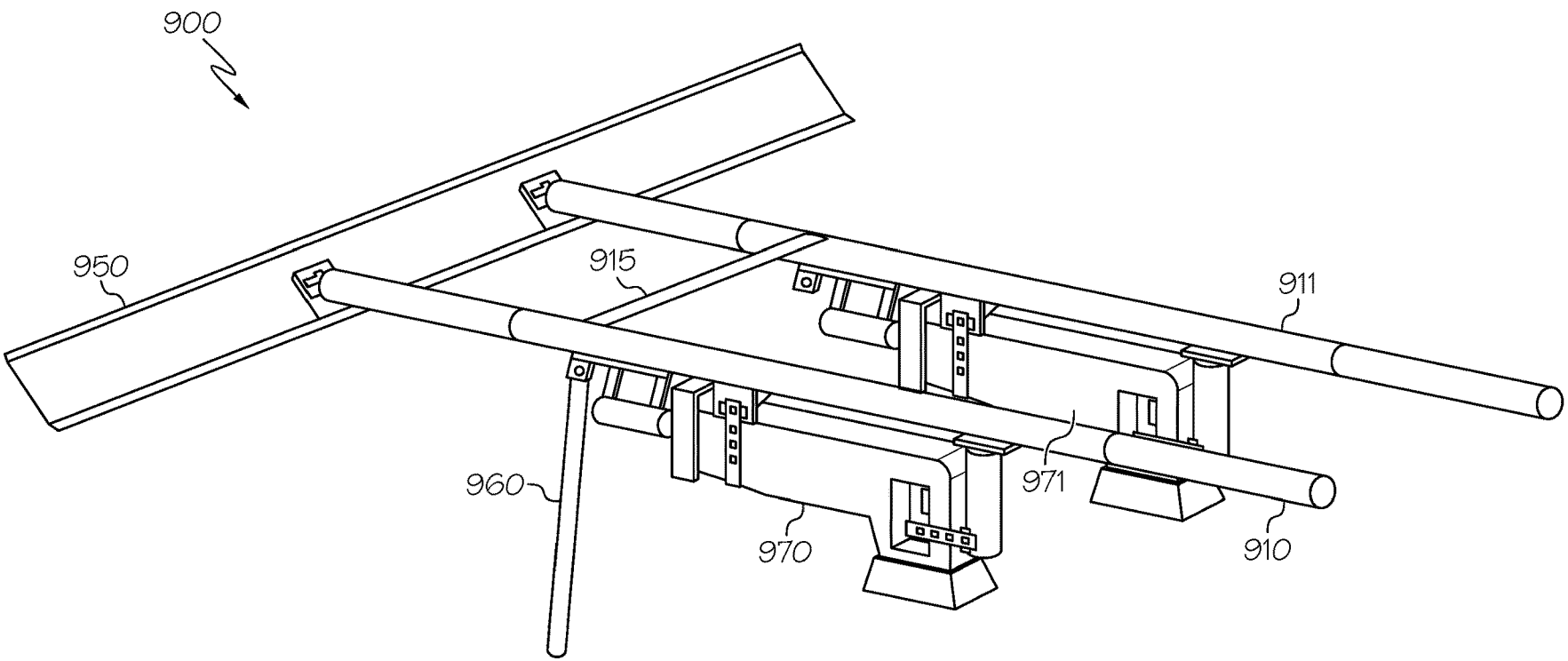
FIG. 9 depicts aspects of the disclosed multi-purpose vibratory concrete tool.

With reference to FIG. 9, some embodiments of the disclosed tool 900 are configured for two-person use. Some two person embodiments include two support poles 910, 911, attached to a single implement 950. Each support pole 910, 911 includes a reciprocating saw 970, 971, and other components as needed. For example, both support poles may not require a support stand 960, controls to actuate the reciprocating saws may be consolidated to one support pole 970, etc. The dual operator tool 900 may also include a crossbar 915 connecting the support poles 910, 911 at a suitable location to provide stability. Other two-person embodiments include a handle extension attached to the support pole and providing a second operator with a handle to assist in control of the tool. The handle extension may include a second trigger or actuator to operate the reciprocating saw.

Figure 10C:
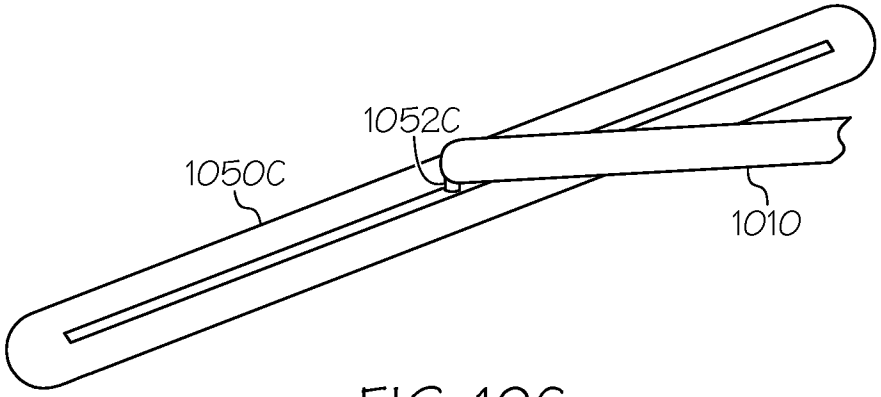
FIGS. 10A, 10B, and 10C depict aspects of alternate implements and connections of the disclosed multi-purpose vibratory concrete tool.
Figure 10A:
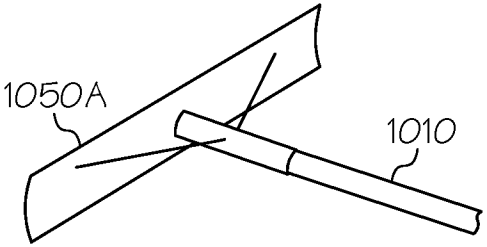
Figure 10B:
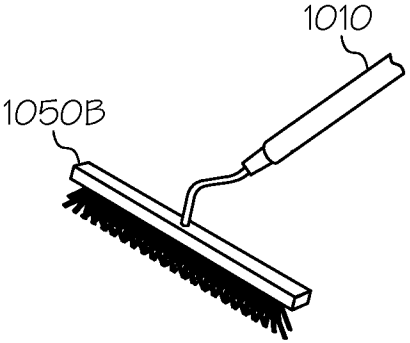

With reference to FIGS. 10A-10C, additional concrete implements are described. FIG. 10A depicts a come-along rake implement 1050A. The come-along implement 1050A may be 16 inches long by 4.5 inches wide and 3/16 inches thick, and is useful for distributing or repositioning wet concrete material to a certain desired level. The vibratory motion provided by the disclosed tool may be required to effectively rake wet concrete materials into below surface grades. FIG. 10B depicts a broom implement 1050B suitable for dislodging dry concrete, applying a final texture finish to wet concrete, or repositioning wet concrete into low areas.

The broom implement has a wood or metal cross member that is, e.g., 4 feet long, and 2 inches wide, with a plurality of 4 inch long bristles made from horse hair, fiber, plastic, or other suitable material. The use of the disclosed vibratory tool with a broom implement can make texturing a concrete surface easier for the user, extending the time available to apply such finishes as the concrete cures. With reference to FIG. 10C, a bull float implement 1050C is depicted attached to the support pole 1010. Since a bull float 1050C and other implements may benefit from a rotating attachment means, the support pole is connected to the implement by a swivel joint 1052C capable of rotating 360°. The bull float implement is made from magnesium, carbon steel, aluminum or another suitable metal or alloy, and may be, e.g., 5 feet long, 12 inches wide, and ½ inch thick. The bull float implement may be used to consolidate wet concrete by releasing captured air pockets that are found in typical concrete mixes. Use of the vibratory tool reduces user fatigue and exertion, and allows efficient floating of concrete for an extended period of time while the concrete cures, or, alternately, can efficiently float concrete that has cured more than anticipated by the user.

Other concrete working implements are possible and contemplated. For example, edging implements provide edge shaping around the perimeter of an installed concrete surface to improve appearance and prevent perimeter spalling. The edging implement is typically a rectangular metal component 6 inches long, 4 inches wide, and 1/16 inches thick, and having a shaped edge on one of the 6 inch sides. Used with the disclosed vibratory tool, an edger can impart shocks to the top edge of concrete borders, allowing the user to more efficiently edge newly installed concrete. Further, use of the vibratory tool extends the period during which curing concrete can be effectively edged, especially in hot weather conditions. Another implement that may be used with the disclosed vibratory tool is a jointing tool or groover. Concrete workers user groovers to install lines in the concrete surface which create controlled breaks for concrete expansion and contraction. A groover is constructed, e.g., by modifying a bull float with a 1.5 inch deep ridge extension placed across the float's short side and centered on the support pole. Use of the vibratory tool with a groover allows the user to more efficiently install separation lines in curing concrete, and extend the time during which effective lines can be installed, particularly in hot weather conditions.

Other Vibratory Tool Configurations

Figure 11B:
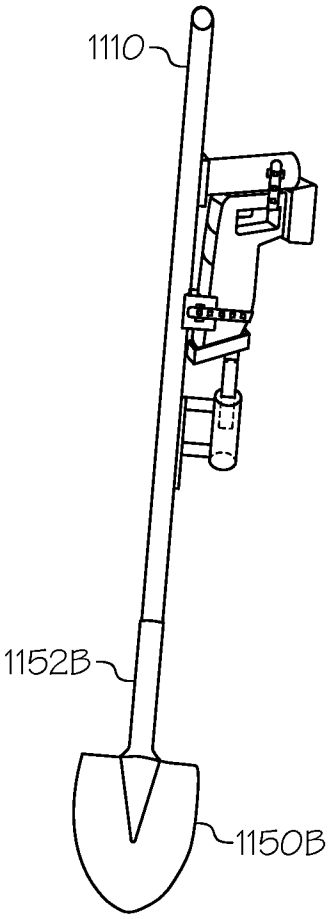
FIGS. 11A, 11B, 11C, 11D, and 11E depict aspects of alternate implements and connections of the disclosed multi-purpose vibratory tool.
Figure 11A:
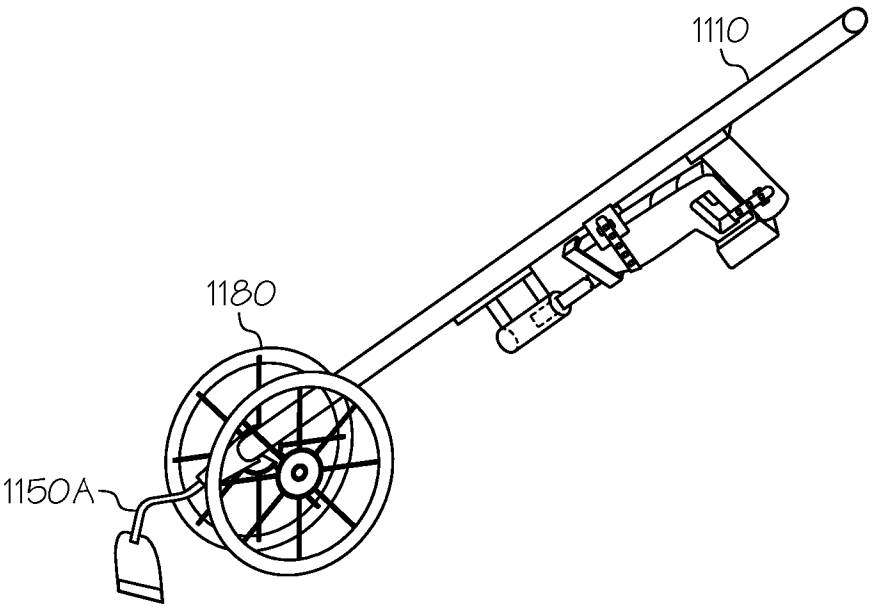
Figure 11E:
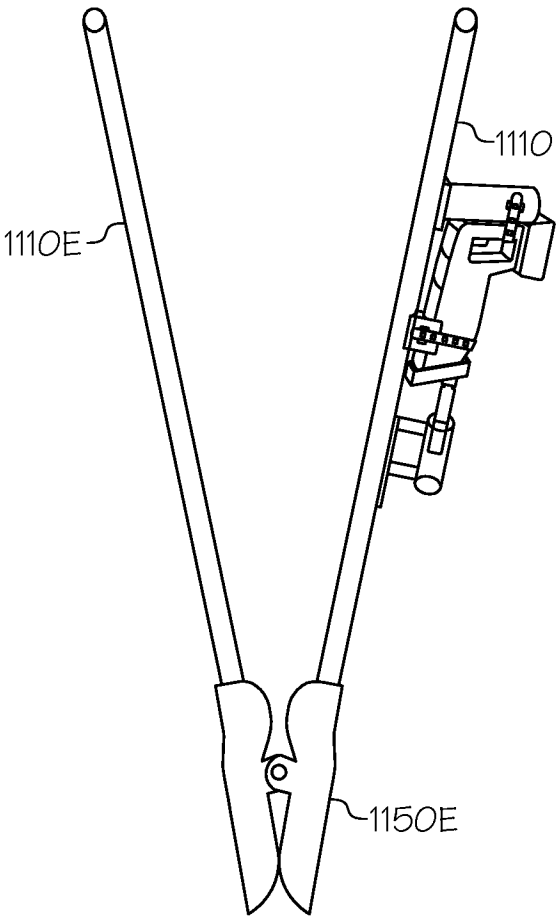
Figure 11C:
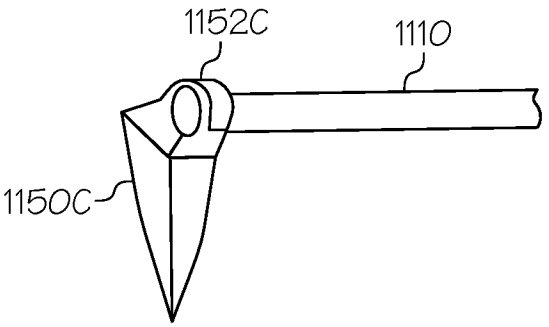
Figure 11D:
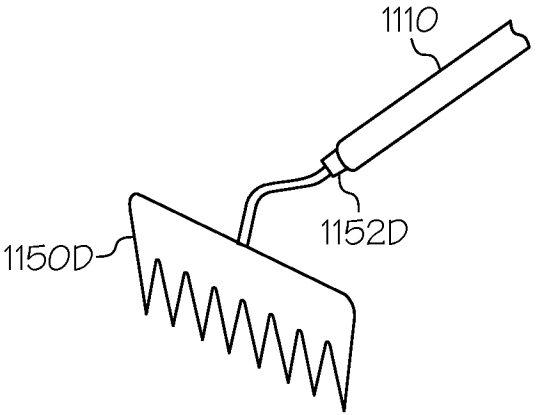

With reference to FIGS. 11A-11E, embodiments of the disclosed vibratory tool may include alternate implements and configurations allowing the vibratory tool to perform other tasks, such as working dirt or soil. With reference to FIG. 11A, various alternative implements (a flat hoe implement 1150A is shown) may be attached to the support pole 1110. Many other implements are possible and contemplated, for example, FIG. 11B shows a shovel implement 1150B attached to the support pole 1110, FIG. 11C shows a triangular-type digging implement 1150C, FIG. 11D shows a rake implement 1150D, and FIG. 11D shows a post hole digger implement 1150E. Implements are made from steel, high carbon steel, aluminum, magnesium, titanium, metal alloys, or other strong, lightweight, durable material. When configured with the various alternative implements, the vibratory tool is designed to scrape soil between crops, remove weeds, move dirt, condition dirt surfaces, agitate slurries and mixtures, as appropriate to each implement's purpose.

Different configurations of the vibratory tool are contemplated based on the different implements and how each is wielded. For example, some embodiments may benefit from one or more wheels 1180 (two are shown) attached to the support pole 1110 to facilitate use of the implement. Other implements, such as the shovel 1150B, are best used without wheels, while others, e.g., the post hole digger 1150E require an additional handle 1110E. Further, implements may be attached to the support pole at a suitable angle, e.g., perpendicular (1150C), in line (1150B, 1150E), or another suitable angle (1150A, 1150D). Further, various attachment means between the implements and support pole(s) are also contemplated. Implements may feature a socket designed to fit over the support pole 1152B, an opening designed to fit outside the support pole 1152C, or an insert designed to fit into the support pole 1152D. Some implements may be attached via a 360° rotating joint as is used for the bull float 1052C. Such connections may be secured by nuts and bolts, plastic clips, screws, snap pole connectors, pins, welding, or other appropriate means.

While this invention has been described in terms of several embodiments, there are alterations, modifications, permutations, and substitute equivalents, which fall within the scope of this invention. Although subsection titles have been provided to aid in the description of the invention, these titles are merely illustrative and are not intended to limit the scope of the disclosed invention. In addition, where claim limitations have been identified, for example, by a numeral or letter, they are not intended to imply any specific sequence. It should also be noted that there are many alternative ways of implementing the methods and apparatuses of the disclosed invention. It is therefore intended that the following appended claims be interpreted as including all such alterations, modifications, permutations, and substitute equivalents as fall within the true spirit and scope of the disclosed invention.

This has been a description of the disclosed invention along with a preferred method of practicing the invention, however the invention itself should only be defined by the appended claims.

What is claimed is:

1. A device for working uncured concrete, the device comprising:

an implement designed to mechanically interact with an uncured concrete surface;

a support pole having a first end connected to the implement, and a second end;

a saw mount for mounting a reciprocating saw to the support pole, wherein the saw mount comprises a bracket secured to the support pole and designed to interact with the reciprocating saw, and a handle adjustably secured to the support pole and designed to interact with a handle portion of the reciprocating saw;

a vibratory mass designed to fit a blade collet of the reciprocating saw; and a mass guide secured to and oriented parallel to the support pole, the mass guide having a first end located nearer to the reciprocating saw, and a second end located nearer to the implement, wherein the mass guide is designed to at least partially surround the vibratory mass when the vibratory mass is secured in the reciprocating saw and the reciprocating saw is mounted to the support pole.

2. The device of claim 1, wherein the mass guide further comprises a strike plate located at the second end and designed to be impacted by the vibratory mass.

3. The device of claim 1, further comprising a gauge frame for connecting the support pole to the implement, the gauge frame comprising a blade interface and a pole interface.

4. The device of claim 3, the gauge frame further comprising one of the following to adjust a vibratory pressure distribution on the implement: a spring adjustor configured to interact with the blade interface and the pole interface; or an adjustment screw configured to interact with the blade interface and an adjustment bar mounted on the implement.

5. The device of claim 1, further comprising a stand for at least partially supporting the device, the stand having a first end rotatably secured to the support pole, and a second end for interacting with a horizontal surface, wherein the stand has a stowed position oriented parallel to the support pole and a deployed position.

6. The device of claim 5, wherein the second end of the stand includes one of: a wheel, or a foot plate.

7. The device of claim 1, wherein the vibratory mass is a thrust rod that extends from the blade collet to a strike plate mounted on the implement, and wherein the thrust rod is configured to contact the strike plate when the blade collet is in an extended position.

8. The device of claim 1, wherein the implement is one of the following: a screed, a float, a bull float, a come-along, a broom, and edger, or a groover.

9. The device of claim 1, further comprising an actuator mounted on the support pole and designed to start, stop, and adjust the speed of oscillations by the reciprocating saw.

10. A system for working uncured concrete, the system comprising:

a reciprocating saw;

an implement designed to mechanically interact with an uncured concrete surface; and a support frame comprising:

a support pole having a first end connected to the implement, and a second end;

a saw mount for mounting the reciprocating saw to the support pole, wherein the saw mount comprises a bracket secured to the support pole and designed to interact with the reciprocating saw, and a handle adjustably secured to the support pole and designed to interact with a handle portion of the reciprocating saw;

a vibratory mass designed to fit a blade collet of the reciprocating saw; and a mass guide secured to and oriented parallel to the support pole, the mass guide having a first end located nearer to the reciprocating saw, and a second end located nearer to the implement, wherein the mass guide is designed to at least partially surround the vibratory mass when the vibratory mass is secured in the reciprocating saw and the reciprocating saw is mounted to the support pole.

11. The system of claim 10, wherein the mass guide further comprises a strike plate located at the second end and designed to be impacted by the vibratory mass.

12. The system of claim 10, further comprising a gauge frame for connecting the support pole to the implement, the gauge frame comprising a blade interface and a pole interface.

13. The system of claim 12, the gauge frame further comprising one of the following to adjust a vibratory pressure distribution on the implement: a spring adjustor configured to interact with the blade interface and the pole interface; or an adjustment screw configured to interact with the blade interface and an adjustment bar mounted on the implement.

14. The system of claim 10, further comprising a stand for at least partially supporting the support frame, the stand having a first end rotatably secured to the support pole, and a second end for interacting with a horizontal surface, wherein the stand has a stowed position oriented parallel to the support pole and a deployed position.

15. The system of claim 14, wherein the second end of the stand includes one of: a wheel, or a foot plate.

16. The system of claim 10, wherein the vibratory mass is a thrust rod that extends from the blade collet to a strike plate mounted on the implement, and wherein the thrust rod is configured to contact the strike plate when the blade collet is in an extended position.

17. The system of claim 10, wherein the implement is one of the following: a screed, a float, a bull float, a come-along, a broom, and edger, or a groover.

18. The system of claim 10, further comprising an actuator mounted on the support pole and designed to start, stop, and adjust the speed of oscillations by the reciprocating saw.

19. The system of claim 10, wherein the reciprocating saw is one of a corded tool, or a battery-powered tool.

* * * * *